US010941594B2

(12) United States Patent
Liu et al.

(10) Patent No.: US 10,941,594 B2
(45) Date of Patent: Mar. 9, 2021

(54) LATCH MECHANISM FOR STORAGE BOX

(71) Applicant: Ford Global Technologies, LLC, Dearborn, MI (US)

(72) Inventors: Frank Qiukui Liu, Canton, MI (US); Francis Raymond Gillis, Farmington Hills, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 627 days.

(21) Appl. No.: 15/431,397

(22) Filed: Feb. 13, 2017

(65) Prior Publication Data

US 2018/0230720 A1 Aug. 16, 2018

(51) Int. Cl.

| | |
|---|---|
| ***E05B 83/28*** | (2014.01) |
| ***E05C 9/04*** | (2006.01) |
| ***E05B 77/38*** | (2014.01) |
| ***E05B 83/30*** | (2014.01) |
| ***E05B 83/32*** | (2014.01) |

(52) U.S. Cl.

CPC ..... *E05B 83/28* (2013.01); *E05B 77/38* (2013.01); *E05B 83/30* (2013.01); *E05C 9/041* (2013.01); *E05C 9/046* (2013.01); *E05B 83/32* (2013.01); *E05C 9/04* (2013.01); *Y10T 292/084* (2015.04); *Y10T 292/0834* (2015.04); *Y10T 292/0836* (2015.04); *Y10T 292/0843* (2015.04); *Y10T 292/0846* (2015.04); *Y10T 292/0856* (2015.04); *Y10T 292/0894* (2015.04); *Y10T 292/0902* (2015.04); *Y10T 292/0966* (2015.04); *Y10T 292/0993* (2015.04); *Y10T 292/1014* (2015.04); *Y10T 292/1018* (2015.04); *Y10T 292/307* (2015.04); *Y10T 292/308* (2015.04)

(58) Field of Classification Search

CPC ..... E05B 83/28; E05B 83/32; E05B 77/38; E05C 9/041; E05C 9/046; E05C 9/04; Y10T 292/0843; Y10T 292/0856; Y10T 292/0834; Y10T 292/0836; Y10T 292/0846; Y10T 292/084; Y10T 292/0894; Y10T 292/0902; Y10T 292/0993; Y10T 292/1018; Y10T 292/0966; Y10T 292/307; Y10T 292/308; Y10T 292/1014

See application file for complete search history.

(56) References Cited

U.S. PATENT DOCUMENTS

| | | | | | |
|---|---|---|---|---|---|
| 131,321 | A * | 9/1872 | Wright | E05C 9/041 | 292/51 |
| 228,241 | A * | 6/1880 | Zimmerman | E05B 63/20 | 292/39 |
| 335,175 | A * | 2/1886 | Blathwayt | E05B 65/0858 | 292/51 |

(Continued)

*Primary Examiner* — Kristina R Fulton
*Assistant Examiner* — Faria F Ahmad
(74) *Attorney, Agent, or Firm* — David L. Coppiellie; Brooks Kushman, P.C.

(57) ABSTRACT

A latch mechanism for a vehicle storage box may include a pair of pawls fixed on opposite sides of a coupler and configured to cause inward translation of one pawl in response to actuation at the other pawl, and a sliding element arranged between each of the pawls and the coupler, the sliding element including at least one retention mechanism to fix the pawl to the sliding element and further including a biasing element to compress the pawl to further engage the pawl with the retention mechanism.

18 Claims, 8 Drawing Sheets

(56) References Cited

U.S. PATENT DOCUMENTS 419,903 A * 1/1890 Wilkins ..... E05B 63/20 292/39
608,461 A * 8/1898 Leach ..... E05C 9/041 292/51
660,403 A * 10/1900 Sutton ..... E05B 63/20 292/39
703,976 A * 7/1902 Southard ..... E05B 65/0858 292/51
932,383 A * 8/1909 Furman et al. ..... E05C 9/041 70/120
1,018,475 A * 2/1912 Bedell ..... E05B 63/20 292/39
1,334,314 A * 3/1920 Parsons ..... E05C 9/041 292/39
1,338,689 A * 5/1920 Massoll ..... E05B 17/007 292/39
1,368,141 A * 2/1921 Hagstrom ..... E05C 9/04 292/34
1,794,171 A * 2/1931 Grutel ..... E05C 9/046 292/45
1,900,503 A * 3/1933 Kemp ..... E05B 63/126 292/33
2,271,431 A * 1/1942 Hauser ..... E05C 9/046 312/333
2,293,363 A * 8/1942 Schell ..... E05B 65/5238 292/37
2,293,942 A * 8/1942 Klahn ..... E05C 9/04 70/63
2,854,708 A * 10/1958 Johnson ..... E05B 65/0841 49/449
3,498,657 A * 3/1970 Fontana ..... E05B 17/0037 292/34
4,193,618 A * 3/1980 Lee ..... B60J 7/0573 292/35
4,204,724 A * 5/1980 Bauer ..... G03B 42/04 206/1.5
4,476,700 A * 10/1984 King ..... E05C 9/041 292/39
4,781,407 A * 11/1988 Rauchhaus ..... B60R 7/06 292/169.11
4,786,091 A * 11/1988 Shiraishi ..... B60J 7/194 292/36
4,786,092 A * 11/1988 Shiraishi ..... B60J 7/194 292/36
4,792,166 A * 12/1988 Shiraishi ..... B60J 7/194 292/36
4,869,549 A * 9/1989 Londeck ..... B60J 7/19 296/224
4,932,691 A * 6/1990 White ..... E05B 53/003 292/336.3
4,934,750 A * 6/1990 Eichler ..... B60R 7/04 296/37.8
4,962,652 A * 10/1990 Schneider ..... E05C 9/041 292/DIG. 14
5,058,938 A * 10/1991 Doring ..... E05C 9/021 292/335
5,193,860 A * 3/1993 Dolman ..... E05B 63/06 292/39
5,709,111 A * 1/1998 Henao ..... E05B 15/108 70/104
5,791,700 A * 8/1998 Biro ..... E05C 9/043 292/36
5,820,170 A * 10/1998 Clancy ..... E05B 65/0858 292/26
5,826,922 A * 10/1998 Wernig ..... E05C 9/041 292/39
5,871,317 A 2/1999 Huber et al.
5,987,943 A * 11/1999 Verga ..... E05B 83/16 292/DIG. 31
6,688,656 B1 * 2/2004 Becken ..... E05B 65/0858 292/26
7,040,671 B2 * 5/2006 Su ..... E05B 63/0013 292/116
7,178,839 B2 * 2/2007 Tsai ..... E05B 65/0858 292/112
7,604,265 B2 * 10/2009 Tsai ..... E05B 65/0858 292/116
7,905,521 B2 * 3/2011 Liang ..... E05B 65/0858 292/112
8,915,683 B2 12/2014 Holzner
8,931,812 B1 * 1/2015 Hauber ..... E05C 19/12 292/26
2003/0006616 A1 * 1/2003 Katoh ..... B60R 7/06 292/32
2003/0116973 A1 * 6/2003 Liu ..... E05B 63/0013 292/26
2004/0195841 A1 * 10/2004 Liu ..... E05B 63/0013 292/24
2004/0227349 A1 * 11/2004 Denys ..... E05B 63/24 292/26
2005/0104380 A1 * 5/2005 Cho ..... E05B 83/30 292/33
2005/0225095 A1 * 10/2005 Geurden ..... E05B 15/1635 292/39
2006/0071478 A1 * 4/2006 Denys ..... E05B 63/12 292/26
2006/0076783 A1 * 4/2006 Tsai ..... E05B 15/024 292/24
2007/0052246 A1 * 3/2007 Blomqvist ..... E05C 9/1875 292/39
2007/0084258 A1 * 4/2007 Matyko ..... E05C 9/042 70/120
2007/0289345 A1 * 12/2007 Kozuka ..... E05B 83/30 70/237
2008/0022730 A1 * 1/2008 Dietrich ..... E05B 63/24 70/158
2010/0071424 A1 * 3/2010 Tsuruta ..... E05B 63/248 70/91
2011/0309640 A1 * 12/2011 Matsubara ..... E05B 63/248 292/159
2012/0132744 A1 5/2012 Huber et al.
2015/0130193 A1 * 5/2015 Kim ..... E05B 83/30 292/32
2016/0339848 A1 * 11/2016 Hodgson ..... E05B 65/0876
2017/0067274 A1 * 3/2017 Yano ..... E05C 9/02
2019/0063119 A1 * 2/2019 Sic ..... E05C 9/04

* cited by examiner

LATCH MECHANISM FOR STORAGE BOX

TECHNICAL FIELD

Disclosed herein are latch mechanisms for storage boxes.

BACKGROUND

Vehicles often include storages boxes such as glove boxes, center consoles, etc. These storage boxes may include handles and locking mechanisms configured to maintain a door of the box in a closed position. However, these mechanisms are subject to wear and tear and often result in noisy arrangements.

SUMMARY

A latch mechanism for a vehicle storage box may include a pair of pawls fixed on opposite sides of a coupler and configured to cause inward translation of one pawl in response to actuation at the other pawl, and a sliding element arranged between each of the pawls and the coupler, the sliding element including at least one retention mechanism to fix the pawl to the sliding element and further including a biasing element to compress the pawl to further engage the pawl with the retention mechanism.

A latch mechanism for a vehicle storage box may include a pair of pawls fixed on opposite sides of a coupler configured to cause inward translation of one pawl in response to actuation at the other pawl, each pawl defining at least one flat side, and a sliding element defining a hollow interior having at least one flat side, the interior configured to receive and align with the flat side of the respective pawl to prevent rotation of the pawl with respect to the sliding element in an installed state.

A latch assembly for a vehicle storage box may include a housing including identical first and second portions, a pair of gears arranged within the housing and configured cause inward translation of a pair of pawls in response to an actuation of one pawl, and a torsion spring including two coils, one surrounding each gear to bias the gears and cause the pawls to rest in an unactuated position.

BRIEF DESCRIPTION OF THE DRAWINGS

The embodiments of the present disclosure are pointed out with particularity in the appended claims. However, other features of the various embodiments will become more apparent and will be best understood by referring to the following detailed description in conjunction with the accompanying drawings in which:

DETAILED DESCRIPTION

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

Vehicles often include storages boxes such as glove boxes, center consoles, etc. These storage boxes may include handles and locking mechanisms configured to maintain a door of the box in a closed position. However, these mechanisms are subject to wear and tear and often result in noisy arrangements. Specifically, when a pawl and sliding element are fixed to each other, the movement and rotation of the pawl with respect to the sliding element may create noise. Further, housing for the latch mechanism may be cumbersome to produce and may also create noise due to poor fittings.

Disclosed herein is a latch mechanism assembly where the pawl and sliding element of a latch for a vehicle storage box are fixed to one another via an attachment mechanism. The attachment mechanism may include a snap-fit arrangement between the pawl and sliding element. The sliding element may include an elastic element configured to compress the snap-fit arrangement to prevent looseness, thus reducing noise.

Further, the pawl and sliding element may each include flat surfaces configured to mate with each other in an installed state. Such configuration may prevent rotational movement between the two fixed parts, further decreasing noise. A coupler housing may include a pair of identical, reciprocal parts, each include locating elements configured to align the housing parts during installation. The locating elements may also maintain certain elements such as springs, gears and sliding elements within fixed locations within the housing to further reduce noise, and minimize wear and tear on the latch mechanism.

Figure 1:
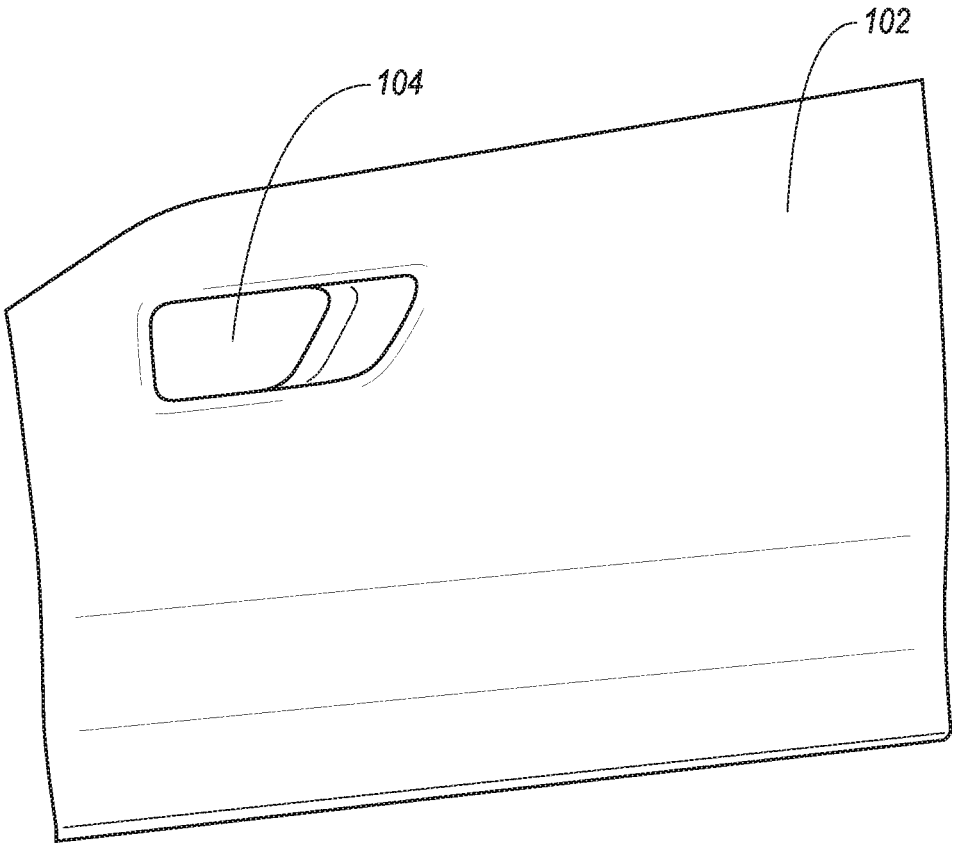
FIG. 1 illustrates a perspective view of an interior of a door of a storage box.

FIG. 1 illustrates an example door 102 of a vehicle storage box. The vehicle storage box (not shown) may include a glove box, center console, or other form of storage compartment typically found in a vehicle. The door 102 may include a handle 104 configured to release the door 102 from the storage box. Upon actuation of the handle 104, the door 102 may open, allowing a user to gain access to the inside of a storage box.

Figure 2:
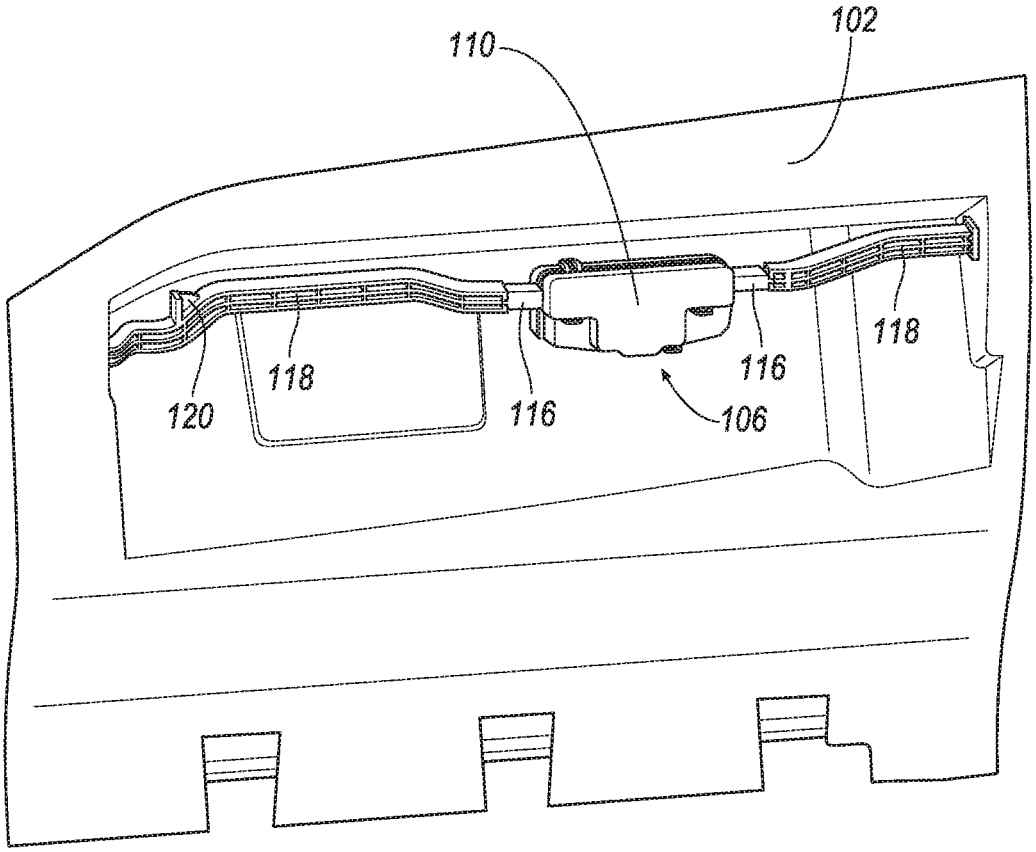
FIG. 2 illustrates an example interior of the door of FIG. 1.

FIG. 2 illustrates an example interior of the door 102. The door 102 may include a latch assembly 106 in communication, at least partially, with the handle 104 (not shown in FIG. 2). The latch assembly 106 may include a latch coupler housing 110 configured to interface with the handle 104. The latch assembly 106 may also include a pair of sliding elements 116*a*, 116*b* (collectively referred to herein as sliding elements 116) extending from the coupler housing 110. A pawl 118 (including pawl 118*a*, 118*b*) may be connected to each of the sliding elements 116. A release mechanism 120 may be arranged at one or both of the pawls 118. While only one release mechanism 120 is illustrated in FIG. 2, more than one release mechanism may be included, specifically, one release mechanism at each pawl 118. The release mechanism 120 may release the door 102 from a locked position, allowing the door to open. The release mechanism 120 may be released upon actuation of the handle 104 which in turn pulls at least one pawl 118 inward, causing the release mechanism to disengage the door 102 with the storage box.

Figure 3:
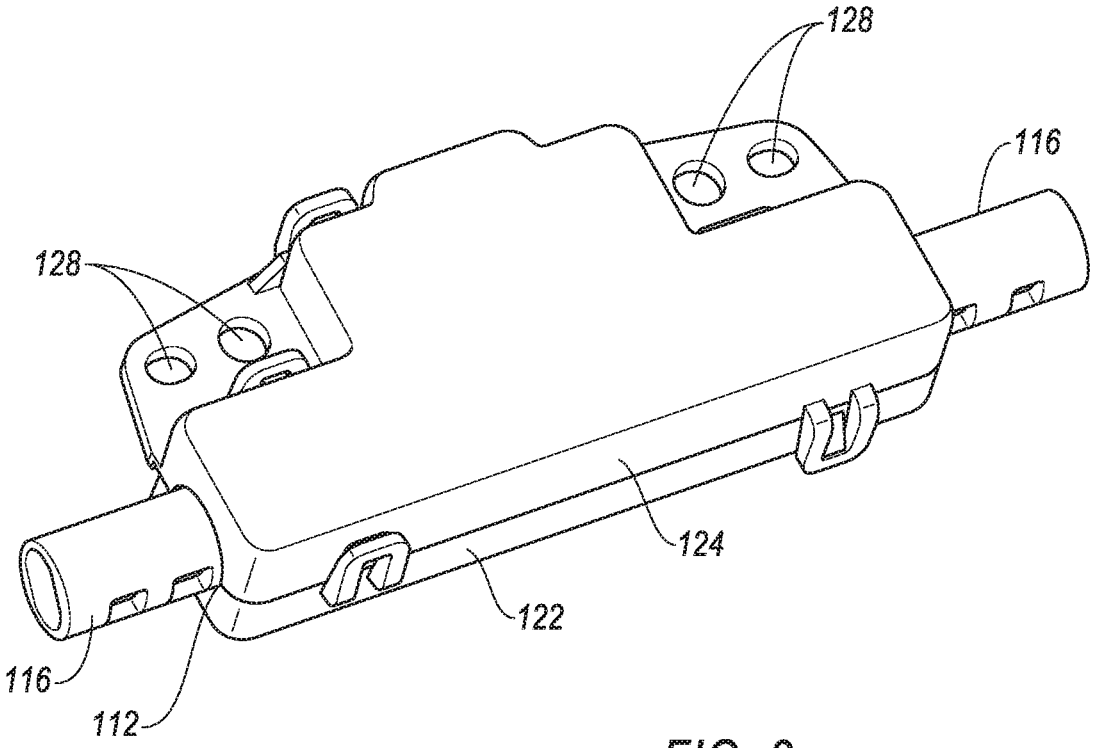
FIG. 3 illustrates the example latch coupler housing of FIG. 2.

FIG. 3 illustrates the example latch coupler housing 110 of FIG. 2. The housing 110 may include a first housing portion 122 and a second housing portion 124. The portions 122, 124 may fit together to form the housing 110. The portions 122, 124 may share a common design in which each may be formed using the same tools. That is, the portions 122, 124 in the unassembled state may be identical or nearly identical, eliminating the need for multiple molds or tools that are typically required for two non-common housing halves. Each portion 122, 124 may define at least one hole 128 which may be configured to receive an attachment mechanism (not shown) to attach the housing 110 to the interior of the door 102. The hole 128 may also function as a locating hole to place the housing 110 in an appropriate and designed location on the door 102. The assembly and additional features of the housing 110 are described below with respect to FIGS. 7 and 8.

Figure 4:
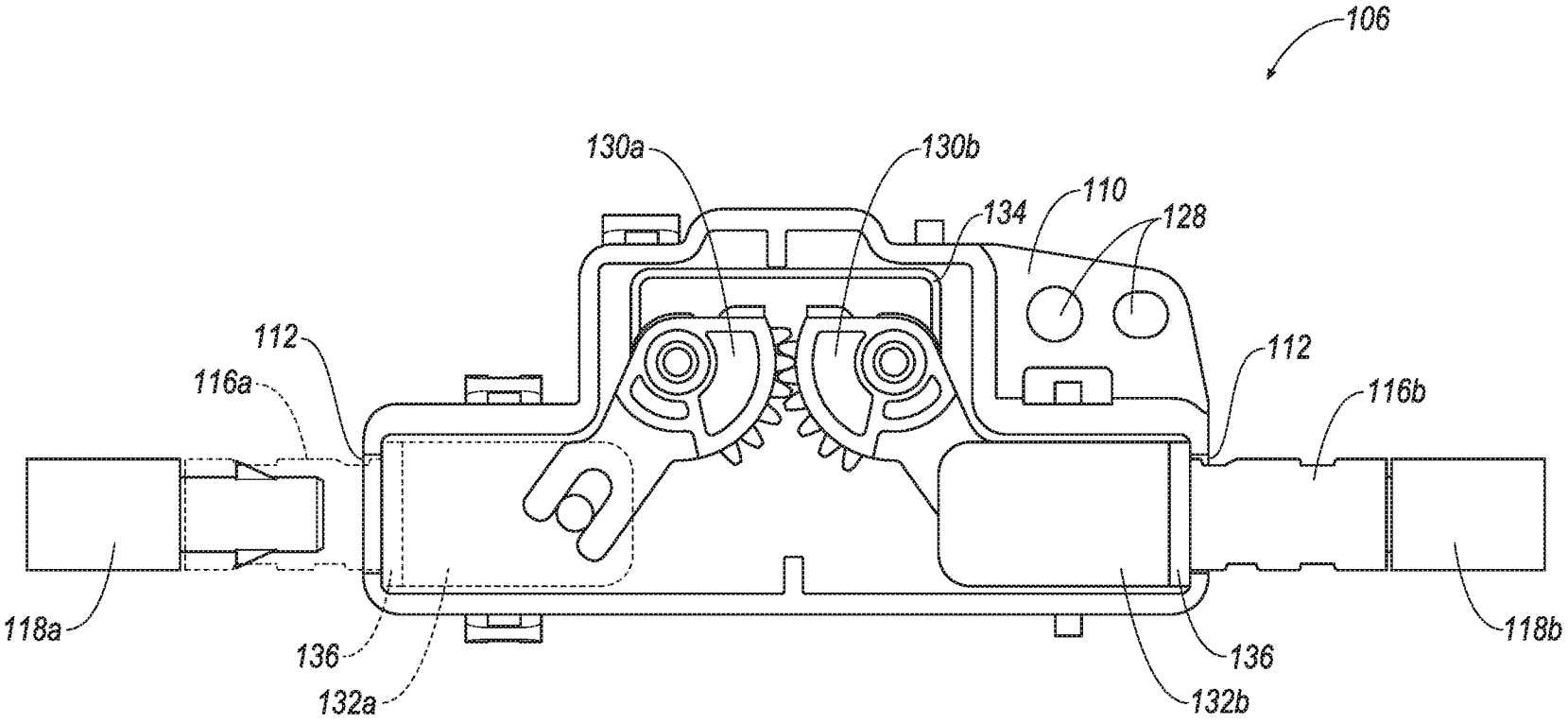
FIG. 4 illustrates a cross-sectional view of a portion of the latch assembly of FIG. 1.

FIG. 4 illustrates a cross-sectional view of a portion of the latch assembly 106. As explained, the latch assembly 106 may include the latch coupler housing 110. A pair of sliding elements 116 may extend outward from respective openings 112 in the housing 110. The sliding elements 116 may be coupled to the pawls 118.

The housing 110 may house a pair of rotary gears 130*a*, 130*b* (collectively referred to as gears 130). A gear attachment 132 may be arranged between each sliding element 116 and respective gear 130. The gear attachment 132 (including gear attachments 132*a*, 132*b*) may be arranged within the housing 110 just inside the opening 112. The gear attachment 132, although shown separately, may be integrated with the sliding element 116 such that the gear attachment 132 and the sliding element 116 form a single integrated part. A washer 136 may be arranged at each opening 112 and may be arranged between an edge of the housing 110 around the opening 112 and the gear attachment 132. The washer 136 may be an NVH (noise, vibration, and harshness) washer, typically used to prevent vibration and noise generated by the vehicle or the operating of the latch mechanism.

A double torsion spring 134 may include two spring coils, each arranged around one of the gears 130. The spring 134 may bias the gears 130 in a resting position and created a tension against the gears 130 such that the gear attachments 132 are forced outward. This provides a force on the sliding elements 116 and the pawls 118 so that the handle 104 is biased in the unactuated position to prevent unintentional actuation thereof and to maintain the door 102 in a closed state. The spring 134 may also force the gears 130 to return to a resting position after actuation of one of the pawls 118.

By arranging the coils directly around the gears 130, the size of the spring may be reduced. This may decrease the cost of the spring as well as the overall weight of the spring 134. The spring 134 may be less likely to slip or move from around the gears 130.

In operation, upon actuation of the handle 104 (not shown in FIG. 4), one of the pawls 118, in this case a left pawl (e.g., pawl 118*a*), may be actuated. Upon actuation of one pawl 118*a*, the sliding element 116*a* attached to that pawl 118*a* may move into the housing 110 through the opening 112. The gear attachment 132*a* may conversely move inward toward a center of the housing 110 and may cause the respective gear 130*a* to rotate. The other gear 130*b* may in turn rotate in the opposite direction due to the engagement with the left gear 130*a*. Rotation of the right gear 130*b* may pull the gear attachment 132*b* inward. In turn, the sliding element 116*b* and left pawl 118*b* may then be pulled inward. Upon pulling of the left pawl 118*b* inward, the release mechanism 120 (not shown in FIG. 4), may release the door 102 from the storage box, allowing the door to open.

Over time, the sliding elements 116 and the pawls 118 may routinely be forced in a lateral direction. That is, the sliding elements 116 and pawls 118 may be pushed and pulled over and over, creating wear and tear on the parts. Such motion may cause the attachment between the pawls 118 and the sliding elements 116 to loosen. Such wear may create unwanted noise and vibrations.

While the examples herein discuss the latch mechanism 106 with respect to the handle 104 actuating the left pawl 118*a*, the opposite pawl 118*b* may be actuated by the handle and the left pawls 118*a* may be pulled inward via the coupling mechanism created by the gears 130.

Figure 5:
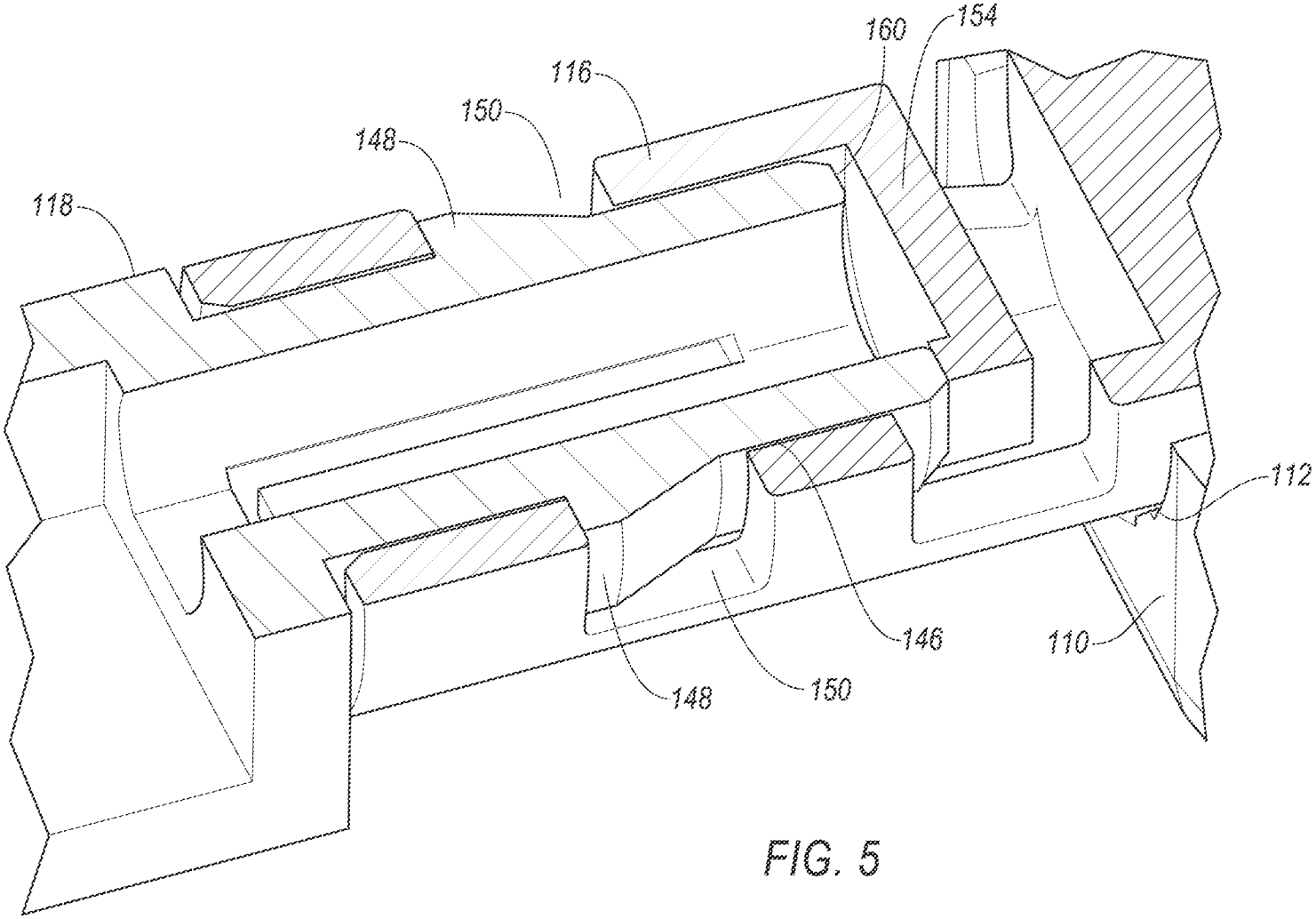
FIG. 5 illustrates a cross-sectional perspective view of a sliding element and a pawl of the latch assembly of FIG. 4.

FIG. 5 illustrates a cross-sectional perspective view of the sliding element 116 and the pawl 118 of the latch assembly 106. The pawl 118 may include a male portion 146. The male portion 146 may be a hollow portion configured to engage with the sliding element 116. The male portion 146 may define at least one projection 148. In the example shown in FIG. 5, two projections 148 are included on the exterior of the male portion. The projection 148 may be semi-pliable in that the projection 148 may be compressible when the male portion is inserted into the sliding element 116.

The sliding element 116 may define a hollow interior configured to receive the male portion 146 of the pawl 118. The sliding element 116 may define at least one opening 150 on the outer periphery thereof. The opening 150 may be configured to align with and receive the projection 148 of the male portion of the pawl 118. As the male portion 142 is inserted into the hollow interior of the sliding element 116, the projection 148 may compress. When the projection 148 align with a respective opening 150, the projection 148 may snap into the opening 150. This snap-fit may maintain the male portion of the pawl 118 within the sliding element 116 and prevent lateral and radial movement of the pawl 118 with respect to the sliding element. The snap-fit arrangement created by the opening 150 and the projection 148 creates a secure fit between the pawl 118 and sliding element 116. In the example shown in the figures, two snap-fit arrangements are illustrated. However, more or less snap-fit arrangements may be included.

A clearance area at the proximate end 160 of the sliding element 116 may be necessary to ensure that the projection 148 may fully engage the opening 150 of the sliding element 116. Once engaged, however, this clearance area may allow for looseness and movement, however slight, between the pawl 118 and the sliding element 116. Such movement may create undesirable noise.

To obviate this looseness, the sliding element 116 may include a biasing element 154 arranged at a proximate end of the sliding element 116. The biasing element 154 may extend into the hollow interior of the sliding element 116. The biasing element 154 may extend to intersect the hollow interior from the exterior surface of the sliding element 116. The biasing element 154 may abut a proximate end 160 of the male portion 146 of the pawl 118 when the pawl 118 is in an installed state with respect to the sliding element 116.

The biasing element 154 may be made of an elastic or semi-formable and pliable material. The biasing element 154 may form an L-shape and may be molded into the sliding element 116. When the pawl 118 is inserted into the sliding element 116 and the snap-fit feature is fully engaged, the pawl 118 may be compressed by the biasing element 154, eliminating the looseness and movement allowed by the clearance area. The elasticity of the biasing element 154 may allow the biasing element 154 to move laterally within the hollow interior of the sliding element 116. The L-shape may permit for a free end of the biasing element 154 to move within the hollow interior. That is, the biasing element 154 may be installed in a 'pre-loaded' position, where the biasing element 154 is biased towards the male portion 146 of the pawl 118. Thus, then the male portion 146 is snap-fit within the sliding element 116, the biasing element 154 applies a force against the proximate end 160 to force the projection 148 to abut a distal side of the opening 150.

Figure 6:
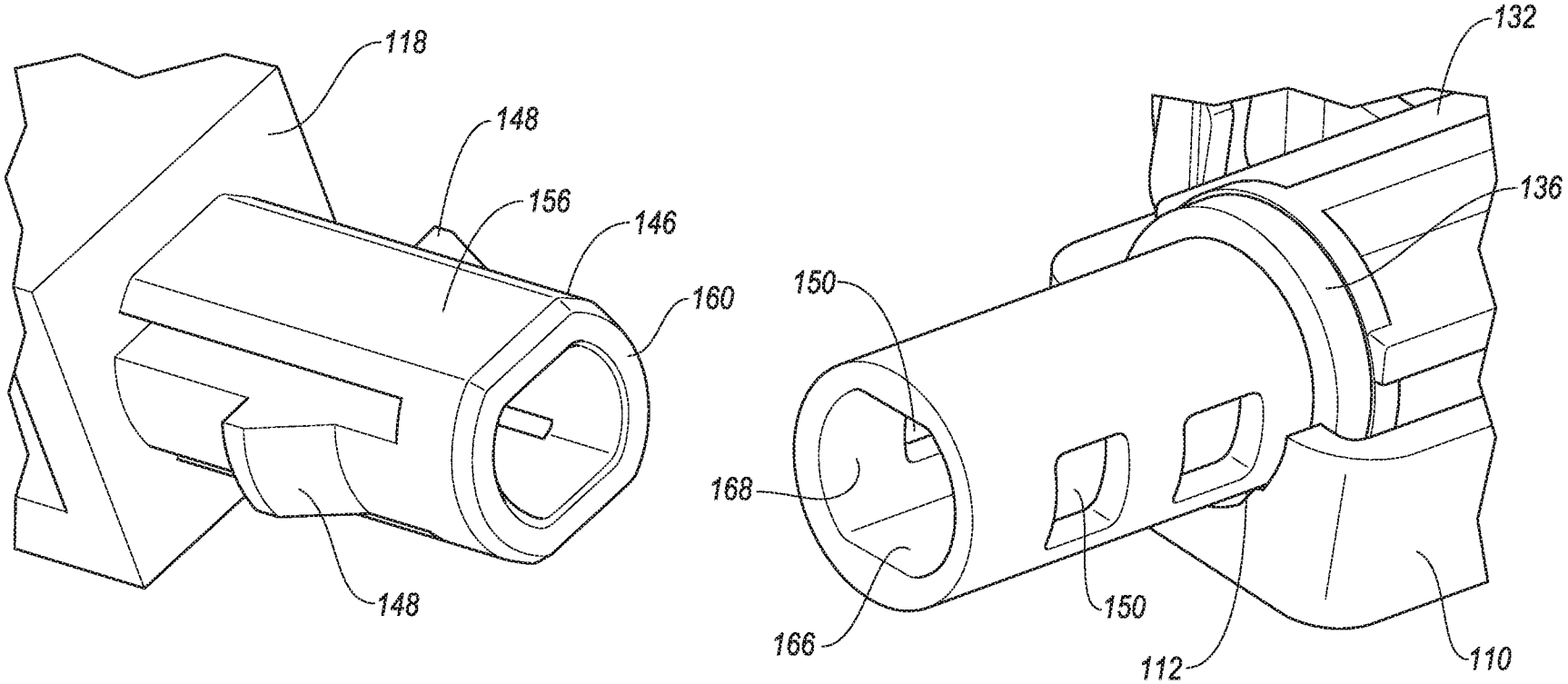
FIG. 6 illustrates a portion of the pawl 118 and the sliding element 116 in an uninstalled state.

FIG. 6 illustrates a portion of the pawl 118 and the sliding element 116 in an uninstalled state. The male portion 146 of the pawl 118 may have at least one flat side 156. In the example shown in FIG. 6, the male portion 146 includes two flat sides 156 interconnected by two rounded sides 158. The projections 148 may be arranged on the rounded sides 158. The hollow interior of the sliding element 116 may define a flat side 166 or flat interior and a round side 168. Similar to the pawl 118, a pair of flat sides 166 may be arranged between a pair of rounded sides 168. When receiving the male portion 146, the flat sides 156 of the pawl 118 may align with the flat sides 166 of the sliding element 116. By including at least one flat side 156 on the male portion 146 to mate with a flat side 166 of the sliding elements 116, i.e., non-circular elements, rotational movement of the pawl 118 with respect to the sliding element 116 is prevented. By preventing any rotational movement between the parts, looseness and noise typically created by such movements may be eliminated.

Figure 7:
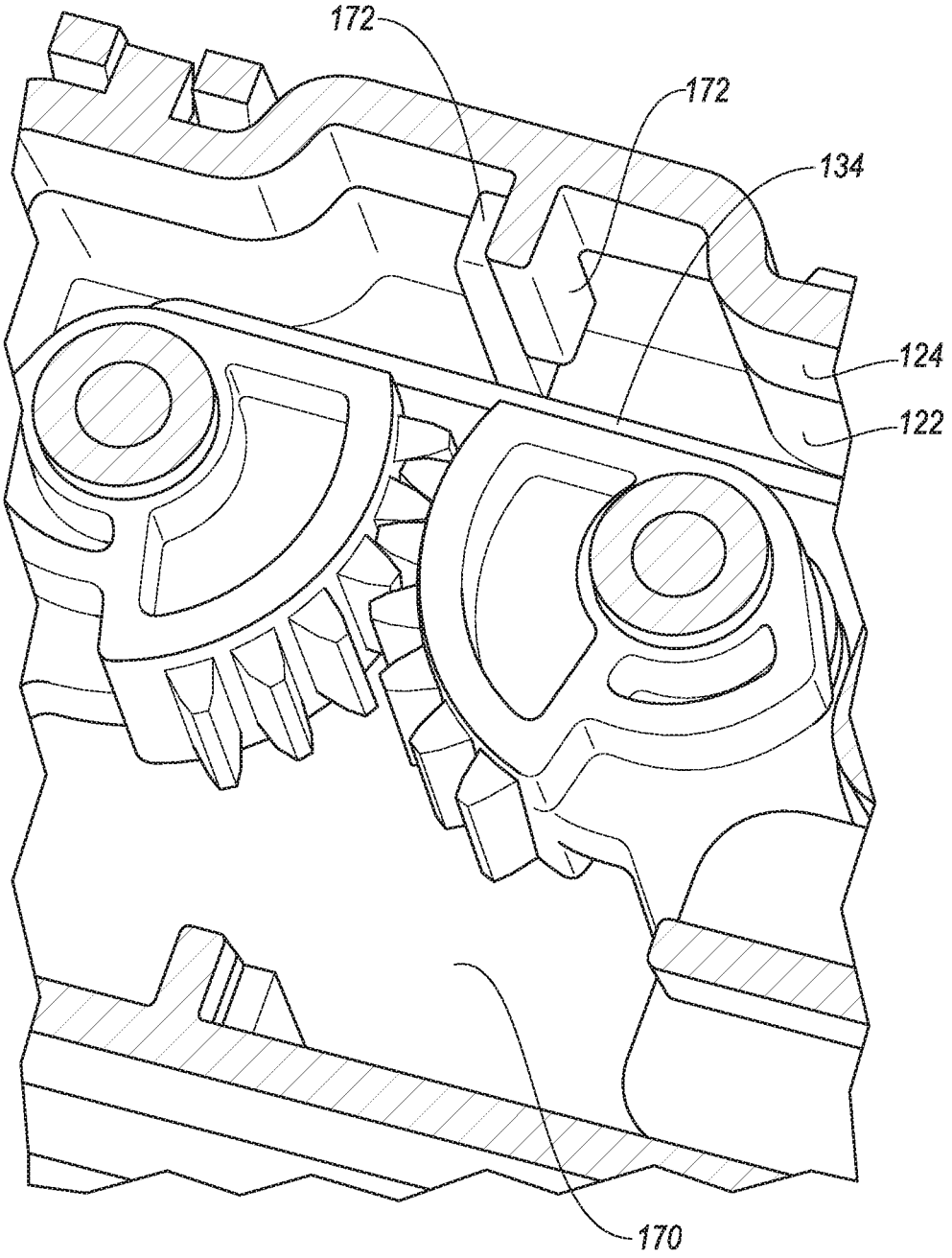
FIG. 7 illustrates a cross-sectional view of a portion of the latch coupler housing 110.

FIG. 7 illustrates a cross-sectional view of a portion of the latch coupler housing 110. Each housing portion 122, 124 may include at least one locating feature 172 arranged on an interior 170 of each portion 122, 124. The locating feature 172 may extend inward from the exterior of the portion. The locating feature 172 also extends upward beyond the edge of the portion 122, 124. In the installed state, the locating features 172 of each housing portion 122, 124 may be abut and align with each other so as to provide a locating mechanism during installation. Because the two halves are common and made from the same mold, the locating features 172 are arranged at the same location around the periphery of the portions 122, 124. When the portions are snapped together, the location feature 172 of one portion, e.g., first portion 122, may abut a corresponding feature 172 of the opposite portion, e.g., second portion 124.

In addition to providing guidance for aligning the two portions 122, 124 during installation, the locating feature may also be configured to abut the double torsion spring 134 to maintain the spring 134 in a fixed location, further preventing vibration or dislocation of the spring. By maintaining the spring 134, potential noise is also reduced.

Figure 8:
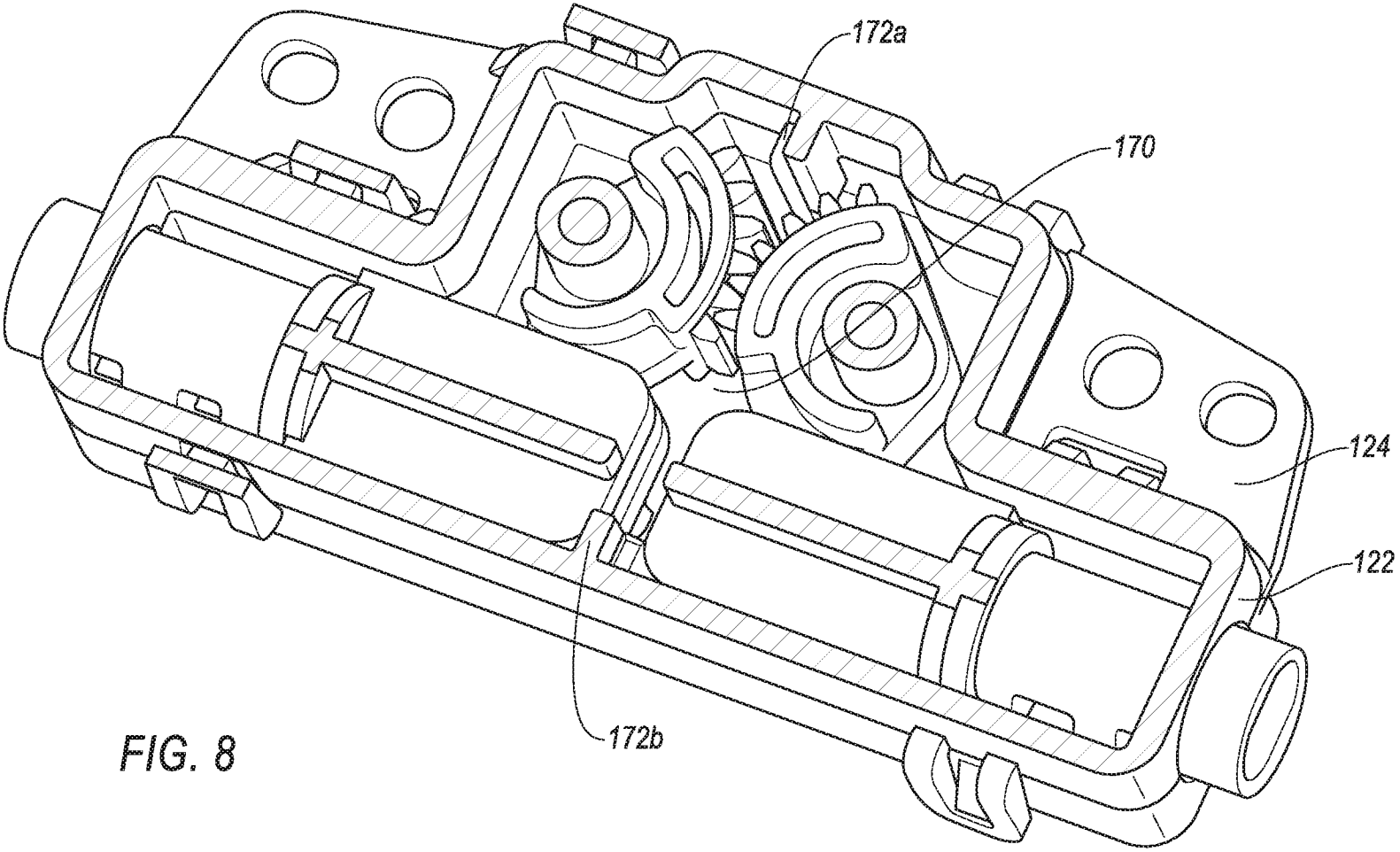
FIG. 8 illustrates another cross-sectional perspective view of the housing.

FIG. 8 illustrates another cross-sectional perspective view of the housing 110 where two locating features 172 are included on each of the portions 122, 124. The first locating feature 172*a* may correspond to the locating feature 172 illustrated in FIG. 7. This locating feature 172 (including locating features 172*a*, 172*b*) may be arranged at one end of the portions 122, 124 and may, in addition to guiding the housing portions 122, 124 together, abut the torsion spring 134. The second locating feature 172*b* may be arranged at an opposite end of the first. The second location feature 172*b* may also provide for alignment of the two portions 122, 124. The second location feature 172*b* may function as a stop for the gear attachments 132 which may be pushed inward towards the center of the housing 110 during operation.

Accordingly, the latch mechanism assembly disclosed herein illustrates a snap-fit arrangement between the pawl and sliding element where the snap-fit is further maintained by an elastic element configured to compress the snap-fit arrangement to prevent looseness, thus reducing noise. The pawl and sliding element may each include flat surfaces configured to mate with each other in an installed state. Such configuration may prevent rotational movement between the two fixed parts, further decreasing noise. The coupler housing may include a pair of identical, reciprocal parts, each include locating elements configured to align the housing parts during installation, creating a cost effective manufacturing process.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A latch mechanism for a vehicle storage box, comprising:

a pair of pawls each fixed to one of a pair of sliding elements, where the sliding elements are attached on opposite sides of a gear pair, the gear pair configured to cause inward translation of one pawl in response to actuation at the other pawl, each pawl including at least two projections; and wherein the sliding element defines at least two openings configured to receive the projections on the pawl to affix to the pawl, and wherein each of the sliding elements include a biasing element to compress the pawl into the openings, wherein the projections are each snap-fit into the opening of the respective sliding element.

2. The mechanism of claim 1, wherein the biasing element is an elastic element configured to compresses the projection into the opening to further engage the pawl within the sliding element.

3. The mechanism of claim 1, wherein the biasing element forms an L-shape elastic element extending from an outer periphery of the sliding element into the sliding element to abut a proximate end of the pawl.

4. The mechanism of claim 3, wherein the biasing element exerts a force at the proximate end forcing the projection to abut an edge of the opening of the sliding element.

5. The mechanism of claim 1, wherein the pawl is configured to have at least one flat side.

6. The mechanism of claim 5, wherein the sliding element is configured to receive a portion of the pawl where the flat side of the pawl is received at a corresponding flat interior of the sliding element to prevent rotation of the pawl with respect to the sliding element in an installed state.

7. A latch mechanism for a vehicle storage box, comprising:

a pair of pawls each fixed to one of a pair of sliding elements on opposite sides of a gear pair, the gear pair configured to cause inward translation of one pawl in response to actuation at the other pawl, each pawl defining at least one flat side, wherein each sliding element defines a hollow interior having at least one flat side, the interior configured to receive and align with the flat side of the respective pawl to prevent any rotation of the pawl with respect to the sliding element in an installed state.

8. The mechanism of claim 7, wherein the sliding element includes at least one retention mechanism to affix to the pawl, and a biasing element extending into the hollow interior to compress the pawl into the retention mechanism.

9. The mechanism of claim 8, wherein each pawl includes a projection and configured to snap-fit into an opening of the sliding element.

10. The mechanism of claim 9, wherein the biasing element is an elastic element configured to compresses the projection into the opening to further engage the pawl within the sliding element.

11. The mechanism of claim 9, wherein the biasing element exerts a force at a proximate end forcing the projection to abut an edge of the opening of the sliding element.

12. The mechanism of claim 8, wherein the retention mechanism includes at least two snap-fit features between the pawl and the sliding element.

13. A latch assembly for a vehicle storage box, comprising:

a housing including identical first and second portions;

a pair of pawls, one arranged in each of the first and second portions;

a pair of reciprocating gears arranged within the housing; and a torsion spring including two coils, one surrounding each gear to bias the gears and cause the pawls to rest in an unactuated position, wherein rotation of one of the gears in a first direction causes rotation of the other one of the gears in an opposite second direction such that actuation at one pawl causes inward translation of the pair of pawls.

14. The assembly of claim 13, wherein each portion includes at least one locating feature extending inward an upward from an edge of the portion and configured to align with another locating feature of the other portion during assembly.

15. The assembly of claim 14, wherein the at least one locating feature is configured to abut the torsion spring to maintain the coils around the gears and prevent vibration thereof.

16. The assembly of claim 14, wherein the at least one locating feature is configured to act as a stop during the inward translation of the pawls.

17. The assembly of claim 13, further comprising a sliding element arranged between each of the pawls and the gears, the sliding element including at least one retention mechanism to fix the pawl to the sliding element.

18. The assembly of claim 17, further including a biasing element arranged within the sliding element and configured to compress the pawl to further engage the pawl with the retention mechanism.

* * * * *